US006575297B2

(12) United States Patent
Schutten

(10) Patent No.: US 6,575,297 B2
(45) Date of Patent: Jun. 10, 2003

(54) EXAMPLE BEARING GUIDE TO THE USE OF A SET OF PRODUCTS AND METHOD OF USING THE SAME

(76) Inventor: Mary E. Schutten, 1719 S.E. Locust Ave., Portland, OR (US) 97214

( * ) Notice: Subject to any disclaimer, the term of this patent is extended or adjusted under 35 U.S.C. 154(b) by 142 days.

(21) Appl. No.: 09/952,354

(22) Filed: Sep. 12, 2001

(65) Prior Publication Data

US 2002/0100700 A1 Aug. 1, 2002

Related U.S. Application Data

(60) Provisional application No. 60/265,936, filed on Feb. 1, 2001.

(51) Int. Cl.[7] ..... B65D 85/58

(52) U.S. Cl. ..... 206/232; 206/459.5; 206/534; 283/115; 283/900

(58) Field of Search ..... 40/661, 701–710, 40/776; 53/473, 474; 206/459.5, 531, 532, 534, 534.1, 538, 539, 232; 283/115, 900

(56) References Cited

U.S. PATENT DOCUMENTS

| | | | | | |
|---|---|---|---|---|---|
| 3,432,951 | A | * | 3/1969 | Cherrin | 206/534 |
| 3,621,992 | A | * | 11/1971 | Osborne et al. | 206/539 |
| 3,773,250 | A | * | 11/1973 | Phillips | 206/459.5 |
| 3,958,690 | A | | 5/1976 | Gee, Sr. | 206/232 |
| 4,231,174 | A | | 11/1980 | Thompson | 40/66.01 |
| 4,553,670 | A | | 11/1985 | Collens | 206/534 |
| 4,621,729 | A | | 11/1986 | Jackson | 206/37 |
| 4,693,371 | A | | 9/1987 | Malpass | 206/538 |
| 4,811,845 | A | * | 3/1989 | Baggett | 206/534 |
| 4,972,657 | A | * | 11/1990 | McKee | 206/534 |
| 5,105,949 | A | | 4/1992 | Blair | 206/534 |
| 5,372,258 | A | | 12/1994 | Daneshvar | 206/534 |
| 5,393,100 | A | * | 2/1995 | Coe | 283/115 |
| 5,803,499 | A | * | 9/1998 | Tung et al. | 283/900 |

* cited by examiner

*Primary Examiner*—Jim Foster
(74) *Attorney, Agent, or Firm*—Law Office of Timothy E. Siegel; Timothy E. Siegel

(57) ABSTRACT

A method of creating a guide to the use of a set of products, which includes an example set of the products. This method includes providing at least one product guide apparatus that includes transparent, flexible material formed into a set of pockets of sufficient size to receive and retain any one of the set of products. The guide also includes material that can be written upon and an associative assembly, adapted to physically associate the material that can be written upon to the transparent flexible material formed into a set of pockets. A first one of the products is placed in a first one of the set of pockets and a second one of the products is placed in a second one of the set of pockets. Next, descriptions of the first and second products are written on the material that can be written upon.

4 Claims, 2 Drawing Sheets

14

Name: Age: Date:

Condition:

Allergies:

Insurance #: Emergency #:

| MEDICINE NAME & STRENGTH | MEDICINE SCHEDULE | | | | PURPOSE & NOTES |
|---|---|---|---|---|---|
| Generic/therapeutic equivalents? | Dose & Days of the Week | Time of Day | | | Side effects? Food requirements? Activities to avoid? |
| | | AM | PM | Eve | |
| | | | | | |
| | | | | | |
| | | | | | |

FIG.2

EXAMPLE BEARING GUIDE TO THE USE OF A SET OF PRODUCTS AND METHOD OF USING THE SAME

This application claim benefit to provisional No. 60/265,936 Filed Feb. 1, 2001

BACKGROUND OF THE INVENTION

The present invention is a method of making a guide for the ingestion of medicines.

The number of Americans that are over 65 is expected to double in the next 30 years from more than 35 million to more than 70 million. This aging population increasingly relies on prescription medications for the maintenance of health. Unfortunately, many patients are faced with a complex daily regimen of prescription medicines; supplements and over-the-counter drugs that are difficult manage. Although a great variety of pillboxes having compartments marked with the days of the week or month are available, these pillboxes must be filled repeatedly, usually weekly. It may be very difficult for family caregivers or gravely ill patients, especially the elderly, to fill the pillboxes correctly. On the market there are pill timers, pill organizers and pill crushers, but no pill identifiers.

Long-term care facilities and home health care programs face this problem many times over. They must keep track of the regimens of many patients. Even one medication error has the potential to result in great liability for such facilities and programs. Moreover, it is necessary to accurately administer medicines despite cost and staffing pressures that can be daunting to those operating these type of facilities and care programs. This year the American Society of Health-System Pharmacists report that "Medication errors may account for one in 12 hospital admissions, one in eight emergency room visits, and occur once every 100 times drugs are administered in the hospital."

The phenomenon of medical professionals making errors that result in the ingestion of an unprescribed medicine, or an incorrect dosage of medicine, is a very serious problem today. It has been estimated that 7,000 patients die each year in the United States as the result of such errors. Moreover, this problem is likely to become even more serious in the future as the population ages and the already high rate (44% in the U.S.) of prescription drug usage grows larger with the discovery of new medicines.

Those responding to medical emergencies typically need to learn as quickly as possible what dosages of medication the patient has been taking. Heretofore, this has typically been attempted through a slapdash search of cabinets and pillboxes, with error, resulting complications and possible death the consequence.

A first effort to address the above noted problems is disclosed in U.S. Pat. No. 4,553,670, granted to Collins ("the Collins patent"). Although the device of Collins is a sort of pill illustrator, with transparent containers for pills and associated areas for receiving written instructions, the bulky construction of the Collins device acts to drive up the price of the device and to prevent storage of a group of such devices together in a notebook. In addition, it appears that the device of Collins would not be reusable.

Another effort to address the above noted problems is disclosed in U.S. Pat. No. 5,372,258, granted to Yousef Daneshvar (the Daneshvar Patent). The Daneshvar patent does appear to disclose a pill sample illustrator having display spaces in which to place pills and associated places to write out instructions for pill consumption. It also appears, however, that the Daneshvar patent implicitly teaches that the illustrator be made out of substantially rigid materials. This is the clear message from the terminology of "walls" and the illustrations, showing apparently substantially rigid walls defining a set of spaces.

This creates two difficulties. First, in the introduction of a new invention, the promoter is frequently faced with a "chicken/egg" problem of production costs. Without making a very large quantity of the product, it is difficult to reduce the production costs to the point where the product can be produced inexpensively enough to induce a large number of sales. Accordingly, a product that can be made inexpensively in small lots has the greatest chance of being made available at prices that the public will be willing to pay, leading to a virtuous cycle of increasing sales. The other disadvantage of the device of the Daneshvar patent is that it is somewhat stiff and bulky. As a result, a library of these devices would be bulky and difficult to maintain in an easily indexed form.

Additionally, various pillboxes and medical history containers have been disclosed, which, as they are not product guides, are not directly relevant to the present invention.

SUMMARY OF THE INVENTION

In a first separate aspect the present invention comprises a method of creating a guide to the use of a set of products, which includes an example set of the products. This method comprises providing at least one product guide apparatus that includes transparent, flexible material formed into a set of pockets of sufficient size to receive and retain any one of the set of products. The guide also includes material that can be written upon and an associative assembly, adapted to physically associate the material that can be written upon to the transparent flexible material formed into a set of pockets. A first one of the products is placed in a first one of the set of pockets and a second one of the products is placed in a second one of the set of pockets. Next, descriptions of the first and second products are written on the material that can be written upon.

In a separate second aspect the present invention is a product guide apparatus for displaying a set of products together with a written description of each of the products. The apparatus comprises, transparent, flexible material formed into a set of pockets of sufficient size to receive and retain any one of the set of products. In addition an associative assembly is adapted to physically associate material that can be written to the transparent flexible material formed into a set of pockets.

BRIEF DESCRIPTION OF THE DRAWINGS

FIG. 2 is an expanded view of the informational section of the product guide apparatus.

DETAILED DESCRIPTION OF THE PREFERRED EMBODIMENT

Figure 1:
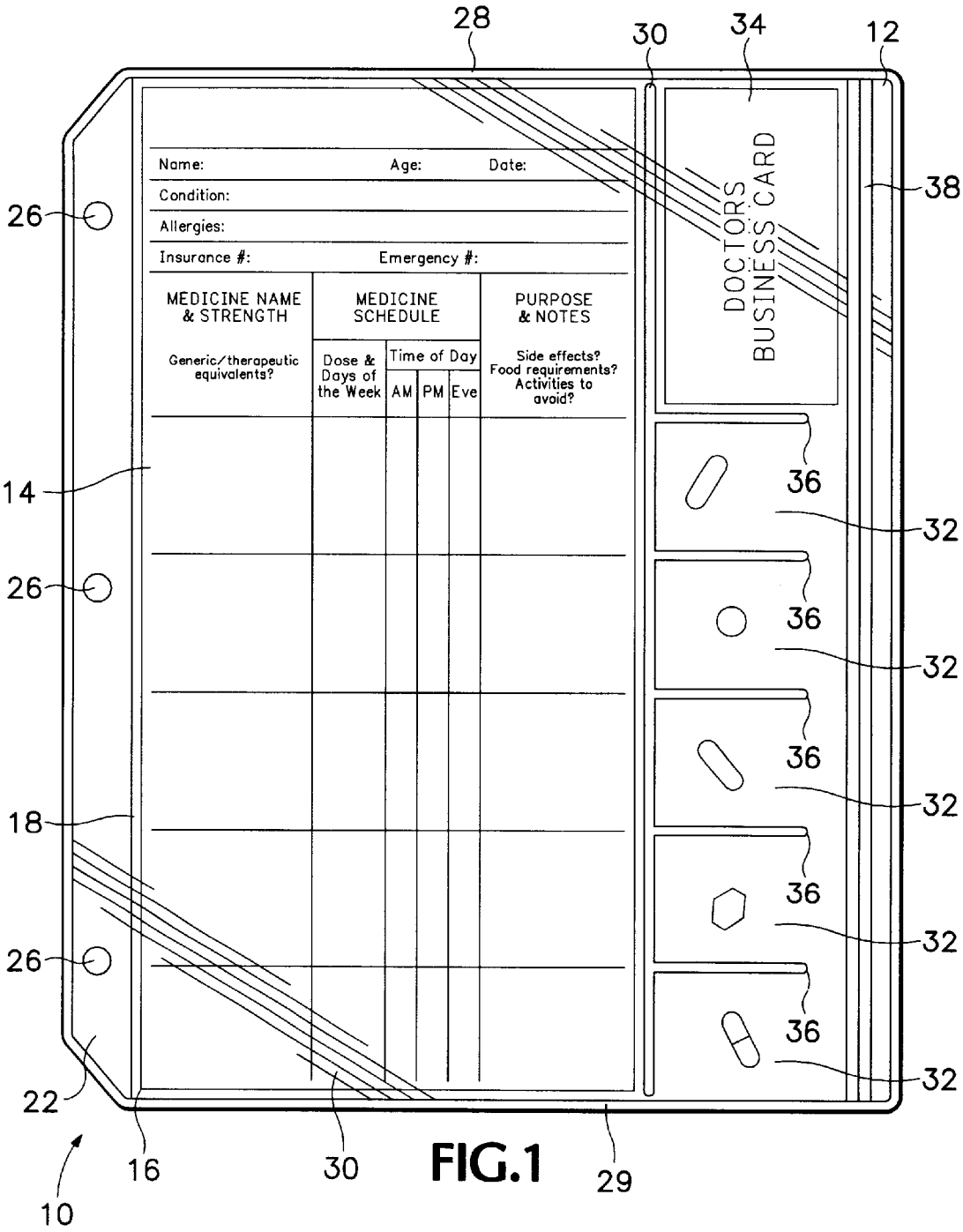
FIG. 1 is a plan view of a product guide apparatus, according to the present invention.

Referring to FIGS. 1–2, a preferred method the present invention may make use of a product guide apparatus 10 that is easily separated into a clear plastic pouch portion 12 and a written guide portion 14, that fits into a written guide pocket 16 of pouch portion 12, through a binder-side slot 18.

The product guide apparatus shown in FIG. 1 is sized to fit into a binder that holds standard 8½" by 11" sheets of paper. An additional preferred embodiment of a product guide apparatus is designed to fit into a smaller "day planner" style of binder. Although the invention is not limited to any particular size of product guide apparatus, one of the advantages of the invention, as noted below, is that a number of product guide apparatuses may be combined in a single binder. This provides a benefit for a caregiver having many patients or for a single patient under a medicinal regimen that requires a great number of medicines to be ingested. A preferred embodiment exists for every popular size of binder.

A front sheet 20 and a back sheet 22 define the pouch portion 12. The back sheet 22 extends outwardly from slot 18 and defines a set of mounting apertures 26. Sheets 20 and 22 are joined together by a top heat seal seam 28 and a bottom heat seal seam 29. A heat seal seam divider 30, extending from top to bottom of pouch portion 12, defines the written guide pocket 16. A set of five pill pockets 32 and a business card pocket 34, are defined by a set of horizontal heat seals 36. An alternative preferred embodiment includes seven pill pockets 32, but no business card pocket. A zip lock strip 38 permits easy opening and closing of pockets 32 and 34. In yet another alternative preferred embodiment pocket 16 does not exist, but written guide 14 is a sheet that is made, for example, out of plastic coated with a roughened white surface material and that is attached to pill pockets 32.

Referring in particular to FIG. 2, the written guide portion 14 is preprinted with a set of prompts to aid a user in filling out the essential information about the patient and the medicines the patient has been asked to consume. At the top of guide portion 14 spaces for the patients name, age, condition allergies, insurance identifying number and telephone number are indicated. Beneath that a grid is formed in which for each pill, spaces are indicated for the medicine name and strength, medicine schedule, medicine purpose, side effects and restrictions on those consuming the particular medicine.

A preferred form of the method of the present invention is as follows. A user places a single pill in each of at least some of the pill pockets 32 and writes the patients name and information at the top of guide portion 14, where prompted. The user then writes a description of each pill, as indicated, in the spaces provided. If the user has many patients to monitor, a number of apparatuses 10 may be prepared in this manner and bound together in a loose-leaf binder. The business card of the user, or some other care provider can be placed in the business card pocket 34.

The present invention provides key advantages to patients and caregivers. The user is prompted for important information, which is then retained in a single place together with examples of the pills that must be consumed. Many patients keep track of their medicines by using a pillbox having pockets for days of the week or month. The guide created by the method of the present invention may serve as a valuable tool to those faced with the task of filling such a pillbox, which may at times be quite complicated. Also, those responding to a medical emergency can quickly and easily gain a thorough knowledge of the medicinal regimen of the patient. Caregivers who have many patients may keep one or several loose-leaf binders filled with guides to help them keep records of the medicinal regimens of their patients.

An additional advantage of the product guide apparatuses 10 of the present invention is that they may be produced inexpensively, even in small quantities. The technology of making products out of sheets of plastic, by means of radio frequency welding, is well developed and inexpensive. Moreover, the required tool that is specific to the manufacture of the product guide apparatuses is quite inexpensive to create.

The terms and expressions which have been employed in the foregoing specification are used as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A product guide apparatus for displaying a set of products together with a written description of each of said products, including:

(a) a thin pocketed device, formed of flexible, conformable material and defining a set of plural first pockets each being of sufficient size to receive and retain any one product of said set of products, said first pockets being separated from one another by a set of first seams in said flexible, conformable material, and defining a second pocket, being larger than any of said first pockets, said first pockets and said second pocket being formed on at least one side of transparent material of said flexible conformable material;

(b) a chart, removably fitted into said second pocket and bearing a set of spaced first lines, each said first line being aligned to a first seam, and bearing a second set of spaced lines intersecting said first lines, headings printed on said chart at positions corresponding to the spacing between said second lines, said first and second lines creating a set of spaces on said chart which coordinate said headings with said first pockets, each said space corresponding to a said first pocket and a said heading, each said space available for writing a description of contents of said corresponding first pocket; and (c) wherein a product guide may be easily produced by placing products in said first pockets and writing product descriptions on said chart in said corresponding spaces.

2. The product guide apparatus of claim 1 wherein said chart further bears a set of second lines, each said second line being perpendicular to said first lines and dividing said spaces into subspaces, and wherein some of said subspaces are preprinted to provide an indication of the type of information to be recorded in each remaining subspace.

3. The product guide apparatus of claim 2 wherein said pocketed device includes a third pocket, sized to fit a business card.

4. The product guide apparatus of claim 2 wherein said pocketed device further defines at least one through-hole near one edge, adapted to permit said pocketed device to be bound in a binder.

* * * * *